US006294002B1

(12) United States Patent
McGee

(10) Patent No.: US 6,294,002 B1
(45) Date of Patent: Sep. 25, 2001

(54) APPARATUS AND PROCESS FOR RECLAIMING TEXTILE FIBER WASTE

(75) Inventor: William E. McGee, Greensboro, NC (US)

(73) Assignee: W. McGee and Associates, LLC, Greensboro, NC (US)

( * ) Notice: Subject to any disclaimer, the term of this patent is extended or adjusted under 35 U.S.C. 154(b) by 0 days.

(21) Appl. No.: 09/426,595

(22) Filed: Oct. 26, 1999

(51) Int. Cl.[7] ..... B01D 46/00

(52) U.S. Cl. ..... 95/279; 95/19; 95/20; 55/282; 55/283; 55/385.1

(58) Field of Search ..... 95/273, 278, 279, 95/280, 19, 20; 55/282, 283, 301, 302, 303, 385.1, 385.2, 470, 338, 339, 340; 15/312.1; 19/107, 145.7

(56) References Cited

U.S. PATENT DOCUMENTS

| | | | | |
|---|---|---|---|---|
| 171,901 | * | 1/1876 | Winton | 55/302 |
| 2,717,484 | * | 9/1955 | Hofstetter | 55/302 |
| 3,178,868 | * | 4/1965 | Gibby | 95/280 |
| 3,604,061 | | 9/1971 | King, Jr. . | |
| 3,648,329 | | 3/1972 | King, Jr. . | |
| 3,678,538 | | 7/1972 | Sloan . | |
| 4,090,857 | * | 5/1978 | Ferri et al. | 55/337 |
| 4,301,573 | * | 11/1981 | Gunter et al. | 19/107 |
| 4,339,333 | * | 7/1982 | Sjöberg | 55/302 |
| 4,342,130 | | 8/1982 | Clark, Jr. et al. . | |
| 4,353,721 | * | 10/1982 | Mollstätter | 55/302 |
| 4,435,197 | | 3/1984 | Nijhawan et al. . | |
| 4,461,633 | * | 7/1984 | Bodovsky | 55/340 |
| 5,174,797 | * | 12/1992 | Yow, Sr. et al. | 95/279 |
| 5,466,271 | * | 11/1995 | Horvat | 55/340 |
| 5,729,862 | | 3/1998 | Ringler et al. . | |
| 5,800,578 | * | 9/1998 | Johnson | 55/340 |

OTHER PUBLICATIONS

Continental Air Systems Product Manual (152 pages, various dates).
Southern Textile News of Charlotte, NC, article entitled "LTG Air Engineering Opens Facility"(unknown publication date).
Grainger catalog p. 499 "Time Delay Relays" (unknown publication date).
Dwyer Instruments, Inc. Quick Ship Catalog, 2 pages "Low Differential Pressure Switches for General Industrial Service" (unknown publication date).
Sketch of prior art fiber separator (mid '70's).

* cited by examiner

*Primary Examiner*—Duane Smith
*Assistant Examiner*—Jason M. Greene

(57) ABSTRACT

Apparatus and process for reclaiming textile fiber waste utilizes an inner perforated duct and an outer continuous duct for removing air-borne fibers from air handling systems of equipment such as cotton carding machinery. A pressure differential switch monitors the operation and when a selected pressure differential occurs, the perforated duct is purged and the collected fibers in the form of a web are drawn through a conduit and returned for further processing.

20 Claims, 4 Drawing Sheets

APPARATUS AND PROCESS FOR RECLAIMING TEXTILE FIBER WASTE

FIELD OF THE INVENTION

The invention herein pertains to collecting and recycling fibers as used in textile manufacturing and particularly pertains to reclaiming fibers collected from carding machine air handling systems.

BACKGROUND AND OBJECTIVES OF THE INVENTION

In most textile manufacturing processes the initial step consists of opening fibers such as cotton to allow the cleaning of the individual fibers and removing the seeds, leaves, and other waste materials therefrom by utilizing a carding operation. This waste material is collected in a pneumatic system and a percentage of usable fibers reclaimed. One of such processes is set forth in U.S. pat. No. 4,301,573. Recycled fibers are blended with new fibers and the carding cycle begins anew. Other prior art systems utilize filter media covering a stationary drum. The filter media is sized to allow air to pass therethrough while fibers or other waste are collected on the external drum surface. The collected waste is then removed from the filter media and recycled as needed. One such collection system is termed "OUTRAVAC" and sold by Continental Air Systems of Winfield, Ala. Another system known as "FIBR-A-FILTER" also sold by Continental Air Systems utilizes a revolving drum to collect fibers whereby the accumulated waste fibers are automatically removed from the filter media by utilizing air evacuation. Another system entitled "SEP-A-RATOR" of Continental Air Systems provides a rotating drum to remove fibers from a low volume air flow.

While such prior art devices and systems are beneficial, cost and complexity presents a major problem for relatively small and low volume carding operations. Accordingly, the present invention was conceived and one of its objectives is to provide an apparatus and process for reclaiming waste fibers such as cotton in an efficient, economical and low cost manner.

It is another objective of the present invention to provide a device to collect usable cotton fibers for reclaiming utilizing somewhat concentric, cylindrical, galvanized metal conduits or ducts.

It is still another objective of the present invention to provide an apparatus connected to a conventional card air handling system for collecting usable discarded fibers by an inner perforated duct which is periodically, pneumatically purged to remove the collected fibers and return them to the opening or other operation.

It is a further objective of the present invention to provide a fiber collector consisting of two aligned ducts whereby purging the collected fibers is regulated by a pressure differential switch.

It is yet another objective of the present invention to improve the fiber reclaiming process of conventional waste handling systems to return a maximum percentage of usable fibers to the textile manufacturing process.

Various other objectives and advantages of the present invention will become apparent to those skilled in the art as a more detailed description is set forth below.

SUMMARY OF THE INVENTION

The aforesaid and other objectives are realized by providing an apparatus and process for reclaiming textile fiber waste such as cotton waste although other fibrous waste could be utilized. Also the apparatus and methods described herein could be used in other industrial applications for reclaiming purposes such as in the tobacco and paper industries. The apparatus utilizes a perforated inner cylindrical duct which receives air-borne fibers from a conventional cotton card air handling system. The fibers are drawn into the perforated duct where they collect along the inner walls between the perforations or apertures as the air is withdrawn into an outer chamber formed by a continuous cylindrical duct which surrounds the perforated duct. The fibers thus collected form a loose mat or web along the inner chamber of the perforated duct which, during prolonged operation blocks the apertures and causes a pressure differential between the outer and inner chambers. This pressure differential is read by a pressure differential switch which controls air directed through a purge conduit joined to the outer continuous duct. Air moving through the purge conduit strikes the collected fibers which are formed in a web and then releases the fibers (web) from the inner chamber walls both due to the pressure differential change and contact with the forced air. The released fibrous web is then drawn through a fiber return conduit which deposits the fibers and/or fibrous web into a hopper for reprocessing in conventional carding equipment. Air drawn through the outer chamber as the fibers collect along the inner chamber is returned through an air return conduit to the card air handling system. By thus collecting and returning usable fibers, waste is thereby greatly reduced at a cost savings to the textile mill or other operation.

DETAILED DESCRIPTION OF THE PREFERRED EMBODIMENT AND OPERATION OF THE INVENTION

Figure 1:
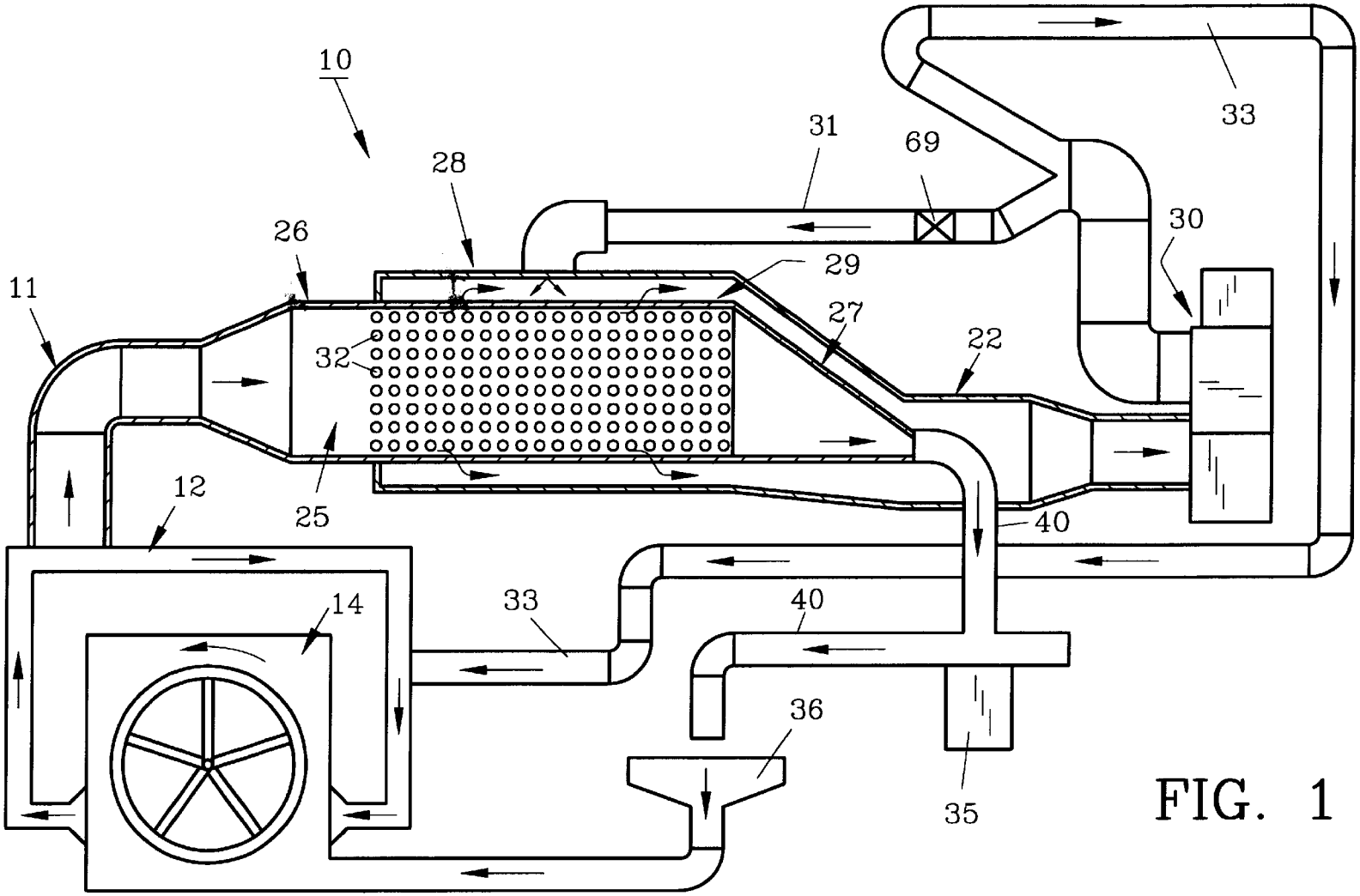
FIG. 1 represents a schematic view of the apparatus for reclaiming textile fiber waste shown in conjunction with a conventional air handling system of textile carding equipment.

For a better understanding of the invention and its operation, turning now to the drawings, FIG. 1 shows in schematic fashion preferred fiber reclaiming apparatus 10 which is approximately 3.3 meters Long joined by conduit 11 to conventional card air handling system 12 of carding equipment 14. As seen, air moves through conduit 11 (about 35.5 cm in diameter) into perforated duct 26 which defines a series of apertures 32 preferably 6 millimeters in diameter. Perforated duct 26 is generally about 0.77 m in diameter and is formed from galvanized metal sheeting as is outer continuous duct 28 which is about 0.94 m in diameter. ("Continuous" as used herein to describe a duct means without openings along the outer surface as contrasted to a "perforated" duct.) Preferred duct 26 has a uniform diameter along its lower or bottom half, whereas the top half narrows in diameter at rear portion 27 as seen in FIG. 1. As further seen ducts 26 and 28 are generally concentrically aligned along their main portions. The configuration of duct 26 allows for cotton or other fibrous materials to exit unimpeded therethrough.

As further shown in FIG. 1, outer duct 28 is spaced from perforated duct 26 about 76 mm and forms outer chamber 29 therebetween. Air passing through conduit 11 enters perforated duct 26 and initially first fan 30 draws air through apertures 32 along conduit 22 at about 2,500 CFM where it is returned to card air handling system 12 via air return conduit 33. Fan 35 likewise draws air through inner chamber 25 of perforated duct 26 and fiber return conduit 40 (about 15 cm in diameter) which returns air-borne fibers into hopper 36 for reprocessing. During processing, as apertures 32 begin to close as fibers collect therein, a greater pressure differential develops between inner chamber 25 and outer chamber 29. When pressure switch 63 (FIG. 2) senses a sufficient pressure difference, standard blast gate 69 opens and fan 30 then drives air along purge conduit 31 to purge perforated duct 26 of fibers as described in more detail below.

Figure 2:
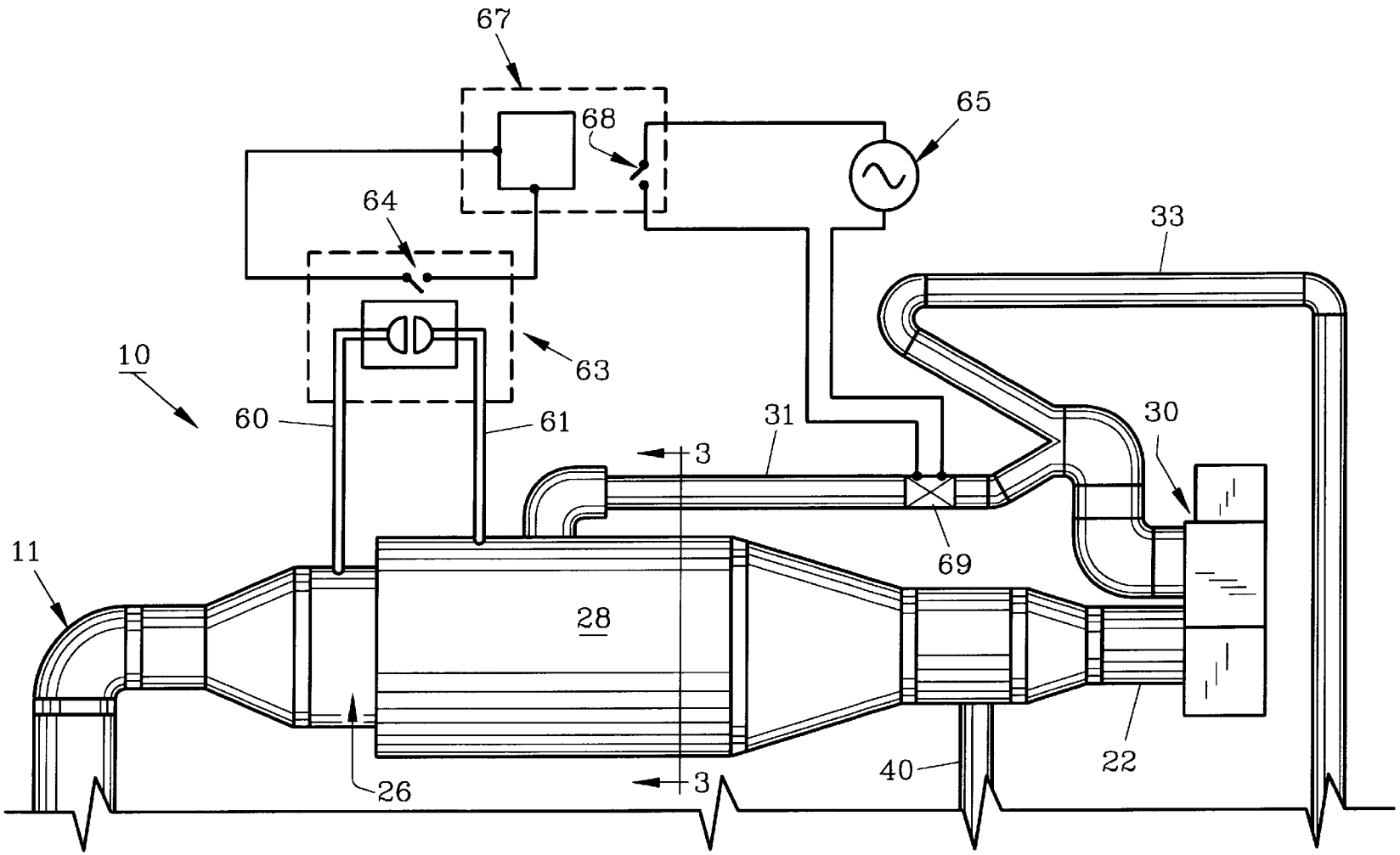
FIG. 2 illustrates t he apparatus of FIG. 1 with pneumatic and electrical schematics.

In FIG. 2, air lines 60, 61 provide pressure information to pressure switch 63 which is commercially available such as from Dwyer Instruments of Michigan City, Indiana as model No. 1823-0, having an operating range of 0.15 to 0.5 inches W.C (Water Column). Upon reaching a predetermined selected pressure differential, pressure switch 63 closes electric snap switch 64 which in turn activates time delay relay 67 and immediately closes electric switch 68. Time delay relay 67 maintains switch 68 in a closed position for a predetermined selected time which may be for example, one to thirty seconds (1–30). When, switch 68 closes, normally closed blast gate 69 opens during the time delay of relay 67 and fan 30 drives air through purge conduit 31 for that selected time period. Time delay relay 67 is conventional and may consist of a Siemens Model No. CNT-35-96 or equivalent commercial relay. Preferred power source 65 demonstrates a conventional 110V A.C. power source.

Air moving through purge conduit 31 is directed through outer continuous duct 28, through outer chamber 29 and through perforated duct 26. The air thus delivered will force, both by direct contact and by lessening the pressure differential between outer chamber 29 and inner chamber 25, fibers collected such as in the form of fibrous web 24 (FIGS. 3 and 4) along the interior walls of perforated duct 26 of inner chamber 25 to release. The released fibers are then forced through fiber return conduit 40 by moving air at about 2,500 CFM by second fan 35 for reclamation as hereinbefore described.

Figure 3:
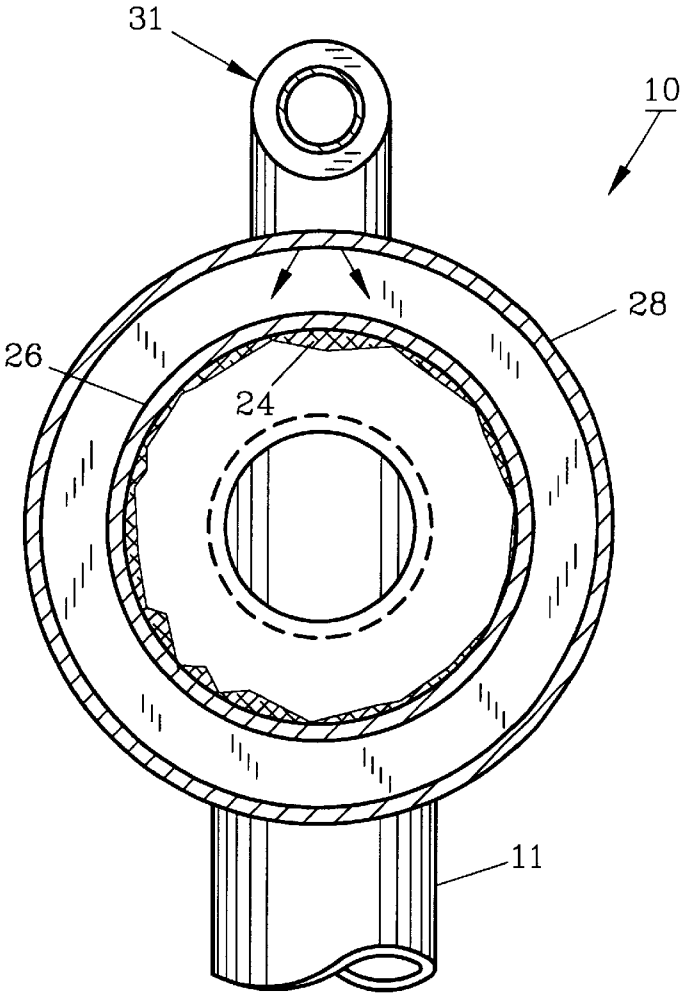
FIG. 3 shows a n enlarged view along lines 3—3 of the apparatus as seen in FIG. 2.

A cross-sectional view of fiber retaining apparatus 10 is shown in, FIG. 3 with perforated duct 26 shown with fibrous web 24 formed thereon from loose fibers before purging. Fibrous web 24 may for example collect to a depth of approximately 5–8 mm before a sufficient pressure differential is reached to activate the purging cycle.

Figure 4:
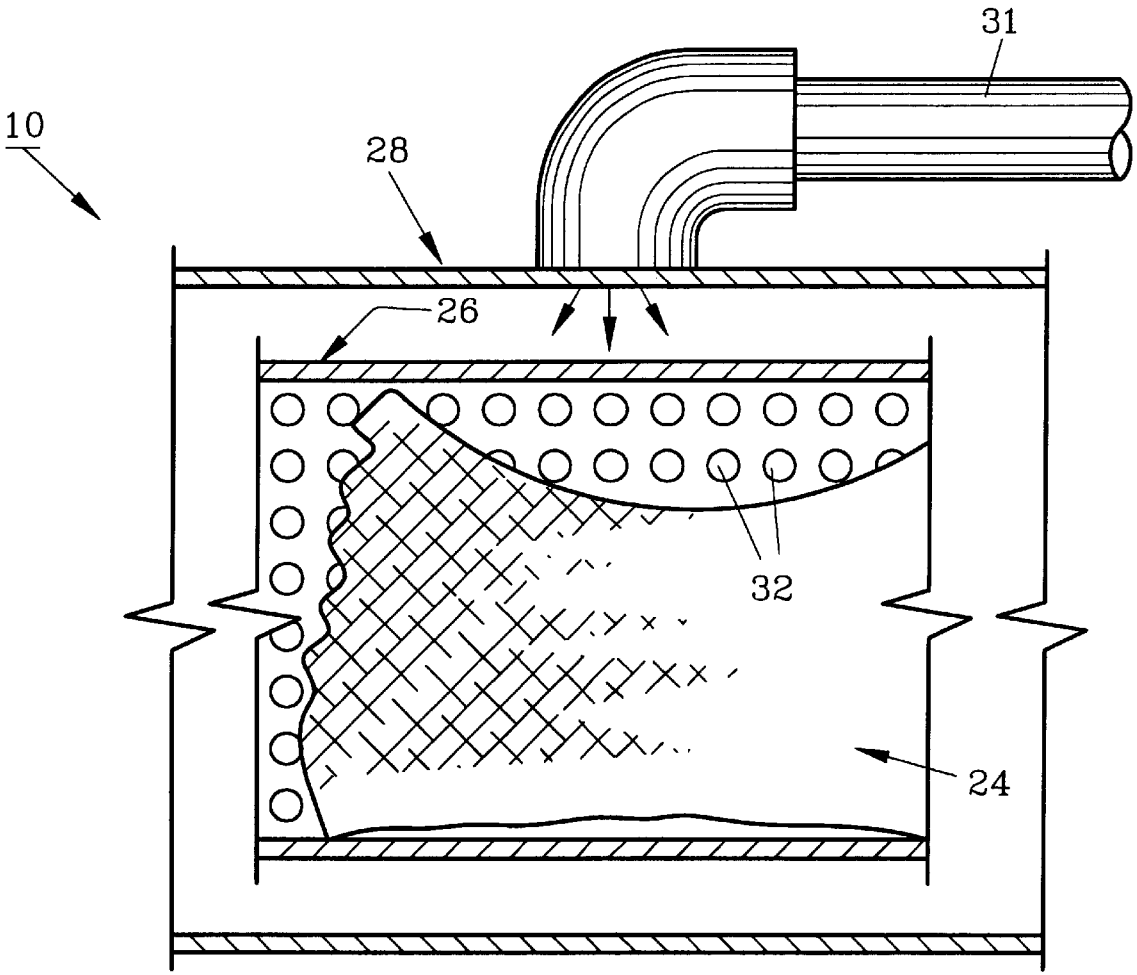
FIG. 4 illustrates an enlarged cut-away view of a section of the apparatus as shown in FIG. 1.

In FIG. 4 a sectional view of apparatus 10 is shown as purging begins. Forced air through purge conduit 31 passes through apertures 32 and causes fibrous web 24 formed from usable cotton or other fibers to release from perforated conduit 26. Once released, fibrous web 24 and/or other fibers therein are directed into fiber return conduit 413 for reclaiming purposes.

The preferred method of reclaiming textile fibers comprises attaching a conduit such as conduit 11 to a conventional card air handling system or other suitable fiber source. Fibers are moved pneumatically into inner chamber 25 formed from perforated cylindrical duct 26. Air is drawn through perforated duct 26 into outer chamber 29 formed by continuous outer duct 28 as shown in FIG. 1. Air passing through perforated duct 26 into outer chamber 29 passes through air return conduit 33 for return to card air handling system 12 as shown therein. As apertures 32 become filled with fiber and fibrous web 24 shown in FIG. 3 has accumulated, pressure switch 63 then activates and closes electrical snap switch 64 which in turn closes electrical switch 68 during the cycle of time delay relay 67. The closing of switch 68 in turn opens normally closed blast gate 69 which allows air driven by fan 30 through conduit 31. Air thus driven passes through outer chamber 29 and apertures 32 causing a change in the differential pressure while urging fibrous web 24 from perforated duct 26. Once released, fibrous web 24 is drawn through fiber return conduit 40 where it passes by fan 35 into hopper 36 for mixing with other fibers and further processing as is usual in textile operations.

The illustrations and examples provided herein are for explanatory purposes and are not intended to limit the scope of the appended claims.

I claim:

1. Fiber reclaiming apparatus comprising: a perforated duct, said perforated duct defining an inner chamber for collecting fibers, a continuous outer duct, said perforated duct contained within said outer duct and spaced therefrom to form an outer chamber therebetween, a purge conduit, said purge conduit in communication with said outer chamber, said purge conduit for delivering air to said outer chamber for releasing fibers collected along said inner chamber, a fiber return conduit, said fiber return conduit in communication with said perforated duct whereby fibers released from said inner chamber will flow into said fiber return conduit, a fiber reprocessing device, said fiber return conduit in communication with said fiber reprocessing device whereby said fibers flowing through said fiber return conduit are delivered to said reprocessing device.

2. The fiber reclaiming apparatus of claim 1 further comprising a pressure differential switch, said pressure differential switch communicating with said outer chamber.

3. The fiber reclaiming apparatus of claim 1 further comprising a pressure differential switch, said pressure differential switch communicating with said outer chamber and said inner chamber.

4. The fiber reclaiming apparatus of claim 1 further comprising a blast gate, said blast gate proximate said purge conduit for controlling air movement therethrough.

5. The fiber reclaiming apparatus of claim 1 further comprising a blast gate, said pressure differential switch in electrical communication with said blast gate.

6. The fiber reclaiming apparatus of claim 1 further comprising a first fan, said first fan in fluid communication with said purge conduit.

7. The fiber reclaiming apparatus of claim 6 further comprising a second fan, said second fan in fluid communication with said perforated duct, said second fan for moving fibers from said inner chamber through said fiber return conduit to said fiber reprocessing device, an air return conduit, a card air handling system, said air return conduit in fluid communication with said outer duct, said purge conduit and said card air handling system, said first fan for moving air through said outer duct and said air return conduit selectively through said purge conduit and said card air handling system, a fiber source conduit, said fiber source conduit in communication with said card handling system and said perforated duct, said fiber source conduit for allowing fiber laden air to flow from said card air handling system to said perforated duct.

8. Fiber reclaiming apparatus comprising: a fiber source, a first conduit, a perforated duct, said perforated duct forming an inner chamber for collecting fibers reclaimed by said first conduit, said first conduit in communication with said fiber source and with said inner chamber, a second conduit, a fiber reprocessing device, a continuous outer duct, said outer duct surrounding said perforated duct to form an outer chamber between said outer duct and said perforated duct, and a purge conduit, said purge conduit in communication with said outer chamber to urge fibers collected within said inner chamber to release the same therefrom, said second conduit communicating with said inner chamber and said fiber reprocessing device whereby fibers collected and released in said inner chamber flow to said fiber reprocessing device.

9. Fiber reclaiming apparatus as claimed in claim 8 further comprising a first fan, said first fan in fluid communication with said purge conduit for directing air therethrough.

10. Fiber reclaiming apparatus as claimed in claim 8 further comprising a first fan, said first fan in fluid communication with said outer chamber for drawing air from said first conduit through said perforated duct and into said outer chamber for return.

11. Fiber reclaiming apparatus as claimed in claim 8 further comprising a pressure differential switch, said pressure differential switch in fluid communication with said inner chamber and said outer chamber to sense the pressure differential therebetween.

12. A process for reclaiming waste fiber comprising the steps of:

a) drawing fibers into a perforated duct;

b) collecting the fibers inside the perforated duct along the apertures;

c) releasing the collected fibers from inside the perforated duct; and d) directing the released fibers from the perforated duct into a fiber reprocessing device via a conduit in fluid communication with said perforated duct and said fiber reprocessing device.

13. The process as claimed in claim 12 further comprising the step of purging the perforated duct to release the collected fibers.

14. The process as claimed in claim 12 further comprising the step of opening a blast gate to purge the perforated duct.

15. The process as claimed in claim 12 further comprising the step of determining a pressure differential within and without said perforated duct before releasing the collected fibers.

16. The fiber reclaiming apparatus of claim 1, wherein said fiber reprocessing device comprises a hopper.

17. The fiber reclaiming apparatus of claim 1, further comprising an air return conduit, said air return conduit in communication with said outer duct whereby air flows from said outer duct.

18. The fiber reclaiming apparatus of claim 17, wherein said air return conduit is in selective communication with said purge conduit and supplies air thereto.

19. The fiber reclaiming apparatus of claim 17, further comprising a card air handling system, wherein said air return conduit, is in communication with said card air handling system and supplies air thereto.

20. The fiber reclaiming apparatus of claim 19, further comprising a fiber source conduit, said fiber source conduit connecting said card air handling system to said perforated duct to allow fiber laden air to flow therethrough.

* * * * *